US009163792B2

(12) United States Patent
Weidman et al.

(10) Patent No.: US 9,163,792 B2
(45) Date of Patent: Oct. 20, 2015

(54) ILLUMINATED HAND WAND

(71) Applicant: ZACAABEL, LLC, Fort Myers, FL (US)

(72) Inventors: Donald Lee Weidman, Hanover, IN (US); Kenneth Greves, Fort Myers, FL (US)

(73) Assignee: ZACAABEL, LLC, Ft Myers, FL (US)

( * ) Notice: Subject to any disclaimer, the term of this patent is extended or adjusted under 35 U.S.C. 154(b) by 0 days.

(21) Appl. No.: 14/338,678

(22) Filed: Jul. 23, 2014

(65) Prior Publication Data

US 2015/0029701 A1 Jan. 29, 2015

Related U.S. Application Data

(60) Provisional application No. 61/857,517, filed on Jul. 23, 2013.

(51) Int. Cl.

| | |
|---|---|
| ***A45B 3/02*** | (2006.01) |
| ***A63B 15/02*** | (2006.01) |
| ***F21V 33/00*** | (2006.01) |
| ***F21S 4/00*** | (2006.01) |
| ***F21V 21/00*** | (2006.01) |
| ***F21L 4/02*** | (2006.01) |
| *F21V 23/00* | (2015.01) |
| *F21W 111/10* | (2006.01) |
| *F21Y 101/02* | (2006.01) |
| *F21Y 105/00* | (2006.01) |
| *F21V 19/00* | (2006.01) |
| *F21Y 111/00* | (2006.01) |

(52) U.S. Cl.

CPC ..... *F21L 4/02* (2013.01); *F21V 19/0045* (2013.01); *F21V 23/005* (2013.01); *F21W 2111/10* (2013.01); *F21Y 2101/02* (2013.01); *F21Y 2105/001* (2013.01); *F21Y 2111/007* (2013.01)

(58) Field of Classification Search

CPC ..... F21L 4/02; F21L 4/027; F21V 23/005; F21V 23/007; F21V 23/0407; F21V 23/0414; F21V 33/0076; F21V 19/003; F21V 19/0035; F21W 2111/10; F21S 10/02; F21S 10/023; F21S 4/008; F21S 4/003; F21S 2/005; F21Y 2105/005; F21Y 2105/003; F21Y 2111/005; A45B 3/04

USPC ..... 362/102, 109, 217.11, 217.12, 217.14, 362/217.15, 217.16, 249.02, 225

See application file for complete search history.

(56) References Cited

U.S. PATENT DOCUMENTS

| | | | | |
|---|---|---|---|---|
| 2006/0092623 | A1* | 5/2006 | Irisawa | 362/102 |
| 2007/0064428 | A1* | 3/2007 | Beauchamp | 362/294 |
| 2008/0094822 | A1* | 4/2008 | Hsu | 362/102 |
| 2008/0291663 | A1* | 11/2008 | Wedell et al. | 362/147 |
| 2009/0045933 | A1* | 2/2009 | Smith et al. | 340/468 |
| 2010/0314985 | A1* | 12/2010 | Premysler | 313/46 |
| 2012/0120640 | A1* | 5/2012 | Graham | 362/183 |

* cited by examiner

*Primary Examiner* — Hargobind S Sawhney
*Assistant Examiner* — William N Harris
(74) *Attorney, Agent, or Firm* — Standley Law Group LLP

(57) ABSTRACT

An illuminated hand wand carrying a plurality of high intensity LEDs is provided as an improved visual signaling device. The hand wand is provided with multiple modes of use and a unique design that may be produced at low costs with high durability and longevity characteristics.

18 Claims, 14 Drawing Sheets

ILLUMINATED HAND WAND

CROSS-REFERENCE TO RELATED APPLICATIONS

This application claims priority to U.S. Provisional Application No. 61/857,517 filed on Jul. 23, 2013 which is herein incorporated by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

TECHNICAL FIELD

Exemplary embodiments of the present invention relate generally to multipurpose hand tools used for visual signaling and more specifically to illuminated hand wands having light emitting diodes (LEDs).

BACKGROUND OF THE INVENTION

There are a number of hand wands on the market today used to provide means for visually signaling others. Visual signaling may be desirable in a wide variety of situations, including traffic direction when parking vehicles, for safety and emergency personal to control traffic flow during periods of abnormally heavy roadway use or at the scene of an accident or in other hazardous or dangerous circumstances, to guide aircraft on the ground to gates, hangers or runways, or when signaling crowds or persons or vehicles at large events. It may be desirable in a number of other such circumstances to have a means for signaling others with visual stimulation that is readily perceived by the persons being signaled.

There are devices known in the art, such as those disclosed in U.S. Pat. No. D 449,011 to Kuvlesky that provide useful features for hand wands. However, these and other prior art devices rely on reflecting light back toward a visual signaling target. Such methods, while useful, may not be readily perceived by the intended targets of the signal and do not employ any self generating light sources.

Some devices currently in use employ the use of a small number of LED light sources of low intensity that are more visible to others during the nighttime than the daytime, being ineffective during the day. Poor perception of current devices by the targets of visual signaling present serious safety issues to safety and emergency workers, as well as other visual signaling subjects. For example, in circumstances involving traffic direction of vehicles traveling on a roadway, poor perception of visual signals by drivers results in less time for the drivers to react to the visual signals. Because of the dangers often associated with situations in which visual signaling is important, there exists a continual need in the art for means of providing a greater distance for visual signaling targets to react to the signals.

In less hazardous situations, users of visual signaling devices also often desire to pair the task of visual signaling with other functions. For instance, police officers directing traffic at checkpoints may desire from time to time to illuminate specific areas. Flashlights may be used, for example, to search the interior of a vehicle during nighttime, or to read documents. In other situations, additional light sources may be needed, such as when changing a tire. These types of multifunction circumstances requires the user of current visual signaling devices to carry one or more devices in addition to the visual signaling device to perform all desired functions. Doing so is cumbersome and inefficient. Therefore, there exists a current need for a visual signaling device with inherent abilities in addition to providing visual signaling.

Additionally, other devices currently available provide only one direction of light, or may provide light emission around the entire perimeter of the device. Both configurations create, respectively, less visibility of the visual signaling device, and impair the vision of the user by directing light unnecessarily toward the user.

Therefore, there exists an unmet need in the prior art for a device that provides solutions to the aforementioned problems.

BRIEF SUMMARY OF THE INVENTION

Exemplary embodiments of the present disclosure pertain to hand wands with improved visibility characteristics and perception by visual signaling targets having a wand housing defining a housing cavity therein and further having a handle portion and a core portion, wherein the core portion has at least three flat sides, each having a surface of reflective material. Embodiments of the hand wand are further provided with a wand core mounted within the housing cavity of the core portion of the wand housing, wherein the wand core has a plurality of front LEDs mounted upon a vertical front PCB facing a front side of the core portion, and a wand core base retained with the housing cavity of the rectangular core portion of the wand housing and coupled to the front PCB thereby restraining movement by the front PCB relative to the wand core base in the horizontal plane. Embodiments are further provided with circular openings in the reflective surfaces and located adjacent to each LED in the plurality of front LEDs.

An object of the present invention is to provide surfaces of opaque reflective material adhesively adhered to the external surfaces of the core portion sides.

Yet another object of the present invention is to manufacture the wand housing by molding from light permeable material to define the housing cavity. The handle portion of the wand housing may be thereafter coated with an opaque material to shield the hand wand components internal to the handle portion from view.

The wand core is further provided with a plurality of top LEDs mounted upon a horizontal top PCB, and a cap coupled to the top PCB. The cap further connects to and closes a top opening in the core portion of the wand housing.

A further object of the invention is to eliminate rattle and internal component damage in the hand wand by providing the wand core base with a set of four downwardly curved legs in rectangular core portion embodiments. The legs extend laterally from the base to be seated upon a set of four interior corner pads extending partially into the core portion cavity from interior vertices. The object is further fulfilled wherein the base is provided with one or more alignment walls projecting upwardly from the wand core base to each receive a bottom edge of a side PCB.

Another aspect of the invention is a switch assembly made of a switch mounted within the handle portion of the wand housing, a switch connector and a power course. The switch connector extends from an electrical connection with the switch and is connected to a wand core switch connector receptacle. The power source is electrically coupled to the switch, and the switch is actuatable between at least two preprogrammed illumination schemes.

The invention further provides at least two preprogrammed illumination schemes including the selection of a subset of actively powered LEDs and a repeatable pattern of LED illumination.

Another aspect of the invention is the hand wand provided with a belt clip mounted on the back side external surface.

In addition to a plurality of front LEDs, yet another object of the invention is the wand core further having a plurality of left LEDs mounted upon a vertical left PCB facing the left side of the rectangular core portion and a plurality of right LEDs mounted upon a vertical right PCB facing the right side of the rectangular core portion. The wand core base is coupled to the front PCB, the left PCB and the right PCB, thereby restraining movement in the horizontal plane, and the top PCB is further electrically coupled to the front PCB, the left PCB and the right PCB.

Other exemplary embodiments of the invented hand wand include a wand housing defining a housing cavity and having a handle portion, a core portion having a front side, a left side and a right side, and a top opening of the core portion. The embodiments are further provided with a wand core having a cap removably connected to and closing the core portion at the top opening, a plurality of top LEDs mounted upon a horizontal top PCB coupled to the cap, a plurality of front LEDs mounted in a vertical row upon a front PCB, wherein the front PCB is electrically coupled to the top PCB and faces the front side of the core portion, and a wand core base connected to the front PCB. Embodiments further include a switch assembly having a switch mounted within the handle portion, a switch connector extending from an electrical connection with the switch and connected to a PCB switch connector receptacle, and a power source electrically coupled to the switch.

Another aspect of the present disclosure is to provide a wand housing further including a handle portion, a core portion formed of a front side, a left side and a right side whereby three interior vertices are defined, and a top opening of the core portion. The wand core may further have a cap removably connected to and closing the core portion at the top opening, a plurality of top LEDs mounted upon a horizontal top PCB coupled to the cap, a plurality of left LEDs mounted in a vertical row upon a left PCB, wherein the left PCB is electrically coupled to the top PCB and faces the left side of the core portion, a plurality of right LEDs mounted in a vertical row upon a right PCB, wherein the right PCB is electrically coupled to the top PCB and faces the right side of the core portion, and a wand core base connected to the left PCB and the right PCB comprising a set of three downwardly curved legs extending to be seated upon a set of three interior corner pads extending into the core portion cavity from the three interior vertices of the core portion.

Other objects of the invention include providing a hand wand further with a wand housing having a handle portion, a core portion having a front side, a left side, a right side and a back side, and a top opening of the core portion, and further with a wand core having a cap removably connected to and closing the core portion at the top opening, a plurality of top LEDs mounted upon a horizontal top PCB coupled to the cap, a plurality of front LEDs mounted in a vertical row upon a front PCB, wherein the front PCB is electrically coupled to the top PCB and faces the front side of the core portion, a plurality of left LEDs mounted in a vertical row upon a left PCB, wherein the left PCB is electrically coupled to the top PCB and faces the left side of the core portion, a plurality of right LEDs mounted in a vertical row upon a right PCB, wherein the right PCB is electrically coupled to the top PCB and faces the right side of the core portion, and a wand core base connected to the front PCB, the left PCB and the right PCB, thereby restraining movement of the front PCB, the left PCB and the right PCB relative to the wand core base in all three orthogonal directions.

The hand wand may further fulfill objects of the present invention with the inclusion of a wand core base further having a set of four downwardly curved legs extending to be seated upon a set of four interior corner pads extending into the core portion cavity. The wand core base is further provided with a front alignment wall projecting upwardly from the wand core base to receive a bottom edge of the front PCB, a front upwardly projecting retention arm having a front locking flange disposed thereon and wherein the front locking flange is snapped into a retention notch of the front PCB, a left alignment wall projecting upwardly from the wand core base to receive a bottom edge of the left PCB, a left upwardly projecting retention arm having a left locking flange disposed thereon and wherein the left locking flange is snapped into a retention notch of the left PCB, a right alignment wall projecting upwardly from the wand core base to receive a bottom edge of the right PCB, and a right upwardly projecting retention arm having a right locking flange disposed thereon and wherein the right locking flange is snapped into a retention notch of the right PCB.

Further aspects of the present invention include a front opaque reflective strip coupled to an exterior surface of the front side of the core portion and having a circular opening located adjacent each LED in the plurality of front LEDs, a left opaque reflective strip coupled to an exterior surface of the left side of the core portion and having a circular opening located adjacent each LED in the plurality of left LEDs, a right opaque reflective strip coupled to an exterior surface of the right side of the core portion and having a circular opening located adjacent each LED in the plurality of right LEDs, and a back opaque reflective strip coupled to an exterior surface of the back side of the rectangular core portion.

Additional exemplary embodiments of the invented hand wand have a wand housing molded of clear material and defining a housing cavity and having a handle portion at a bottom end of the wand housing, a bottom opening of the handle portion, a rectangular core portion at a top end of the wand housing and having a front side, a left side, a right side, and a back side, and a top opening of the core portion, a wand core having a cap removably connected to and closing the core portion at the top opening, a plurality of top LEDs mounted upon a horizontal top PCB coupled to the cap, a plurality of front LEDs mounted in a vertical row upon a front PCB, wherein the front PCB is electrically coupled to the top PCB and faces the front side of the core portion, a plurality of left LEDs mounted in a vertical row upon a left PCB, wherein the left PCB is electrically coupled to the top PCB and faces the left side of the core portion, a plurality of right LEDs mounted in a vertical row upon a right PCB, wherein the right PCB is electrically coupled to the top PCB and faces the right side of the core portion, and a wand core base connected to the front PCB, the left PCB and the right PCB, thereby restraining movement of the front PCB, the left PCB and the right PCB in the horizontal direction, a switch assembly having a switch mounted on and closing the handle portion at the bottom opening and wherein the switch is actuatable between at least two preprogrammed illumination schemes, a switch connector extending from an electrical connection with the switch and connected to a PCB switch connector receptacle, and a power source electrically coupled to the switch, a front reflective strip coupled to an exterior surface of the front side of the core portion and having a circular opening located adjacent each LED in the plurality of front LEDs, a left reflective strip coupled to an exterior surface of the left side of the core portion and having a circular opening located adjacent each LED in the plurality of left LEDs, a right reflective strip coupled to an exterior surface of the right side of the core portion and having a circular opening located adjacent each LED in the plurality of right LEDs, and a back reflective strip coupled to and exterior surface of the back side of the rectangular core portion.

These exemplary embodiments may further be provided wherein the plurality of top LEDs are comprised of a set of white LEDs and a set of red LEDs, and wherein the plurality of front LEDs, the plurality of left LEDs and the plurality of right LEDs are each comprised of red LEDs.

Yet another aspect of the hand wand includes wherein at least two preprogrammed illumination schemes comprise a circuit activating only the red LEDs in a pulse pattern for use as an attention getting device, and a circuit activating only the white LEDs for use as a flashlight device.

These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
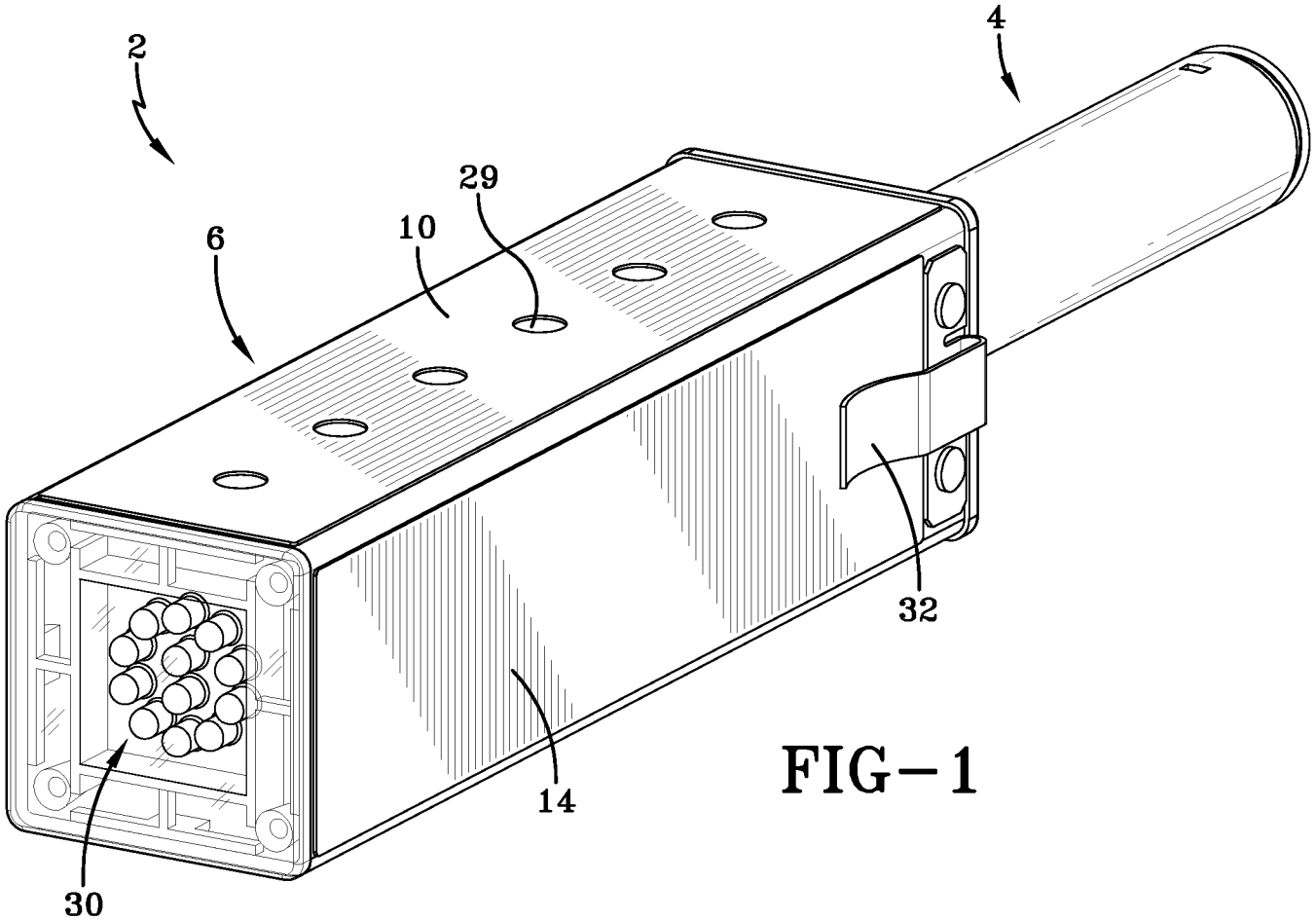
FIG. 1 is an elevated back left perspective view of an exemplary embodiment of the invention.

Exemplary embodiments of the present invention are directed to illuminated hand wands that provide enhanced visibility to visual signaling targets. Other embodiments also provide the user of the illuminated hand wand with the ability to utilize the device to carry out other tasks, such as illuminating objects and areas for the user to aid in nighttime vision. One such exemplary embodiment is depicted in a perspective view of a hand wand 2 in connection with FIGS. 1-3. The hand wand 2 has a hollow wand housing forming the exterior of the wand and defining a housing cavity therein. The housing has a handle portion 4 for gripping at a bottom portion of the housing and a core portion 6 in which the light emitting diodes (LEDs) are housed at a top portion. The hand wand 2 is shown in this particular embodiment with a four sided core portion 6, defined by a front side 8, a left side 10, a right side 12 and a back side 14.

Figure 2:
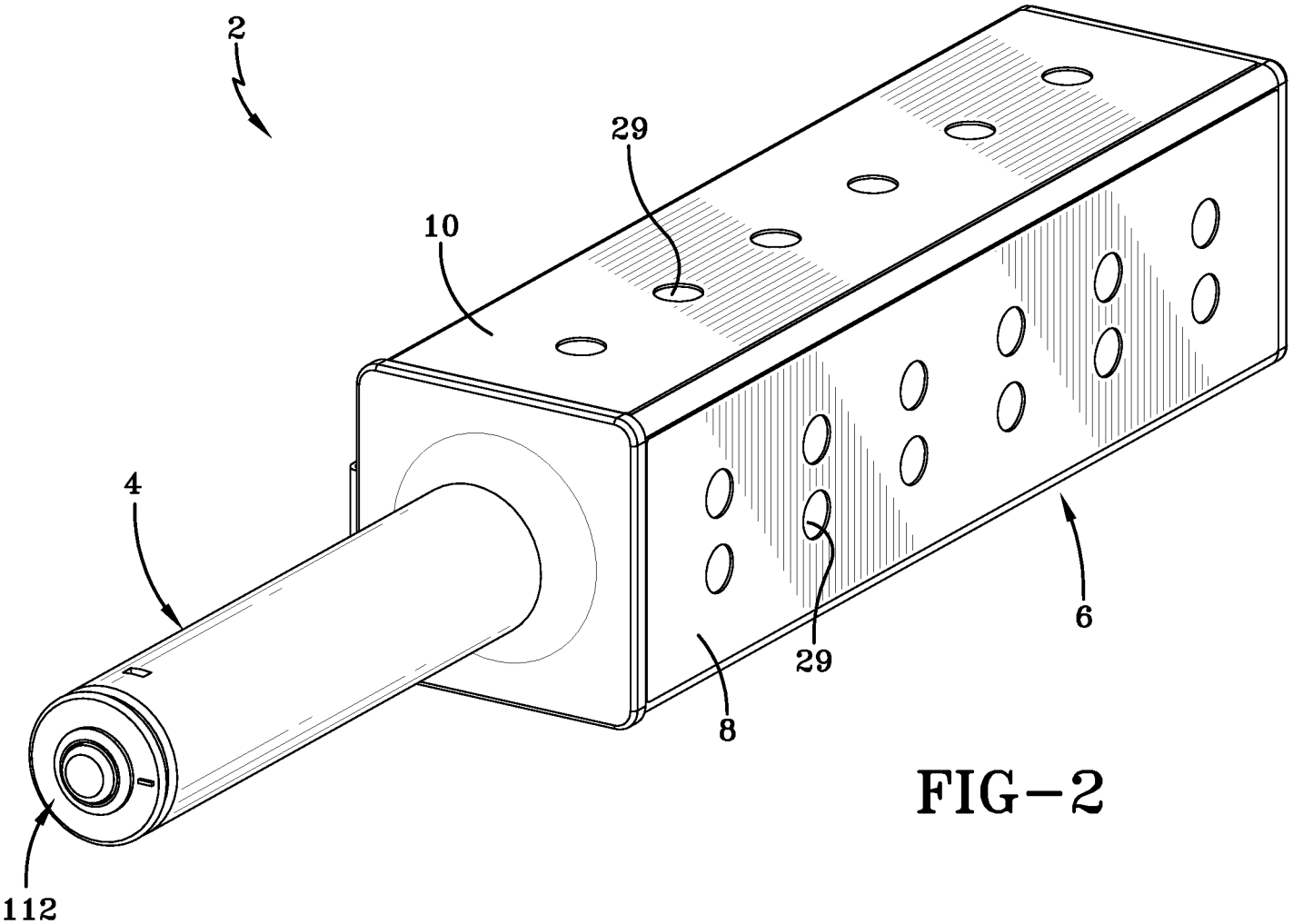
FIG. 2 is a lower front left perspective view of the embodiment shown in FIG. 1.
Figure 3:
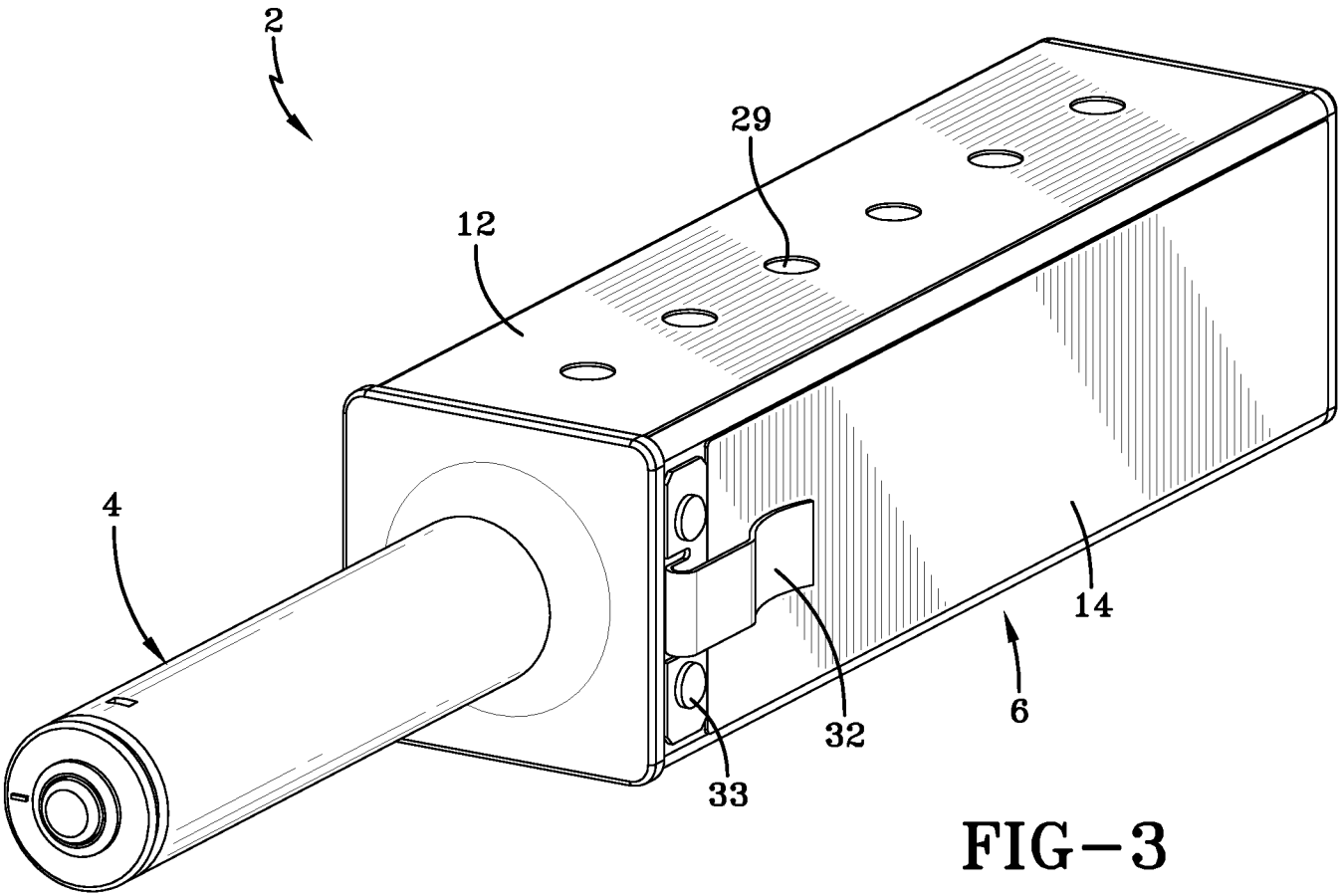
FIG. 3 is a lower back right perspective view of the embodiment shown in FIG. 1.
Figure 4:
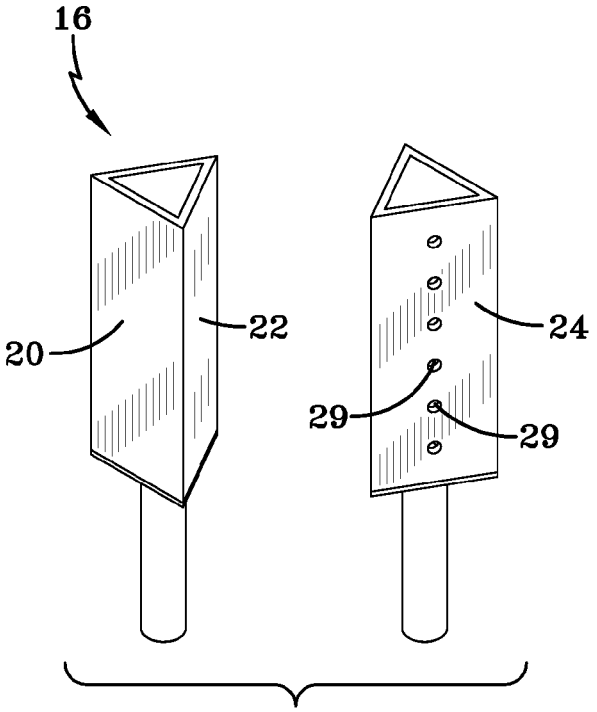
FIG. 4 is an first alternative embodiment of the invention.
Figure 6:
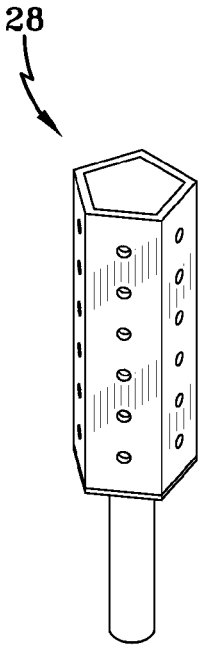
FIG. 6 is a third alternative embodiment of the invention.
Figure 5:
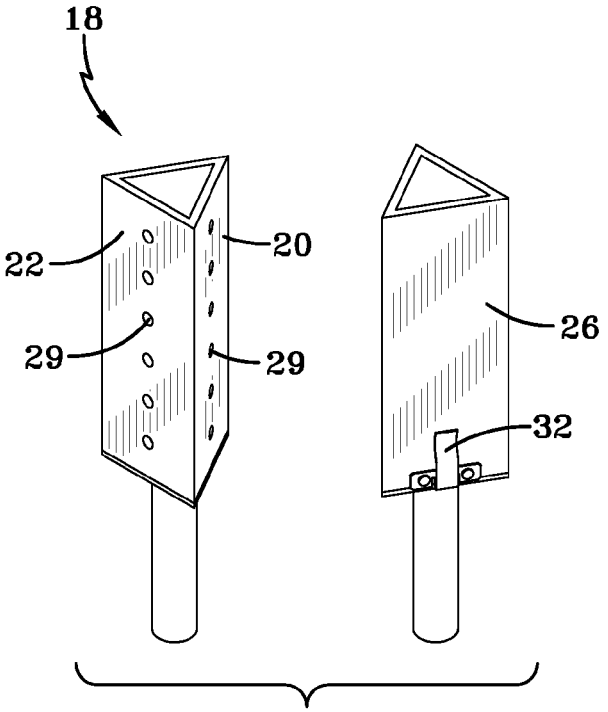
FIG. 5 is a second alternative embodiment of the invention.

The core portion may be generally rectangular shaped and is preferably square shaped, as shown in the exemplary embodiment depicted in FIGS. 1-3. Alternatively, the core portion may be configured with three sides in a generally triangular shape, as shown in the exemplary embodiments 16 and 18 shown in FIGS. 4-5. The hand wands depicted in FIGS. 4-5 are provided with a left side 20 and a right side 22, and with either a front side 24 or a back side 26. Alternatively, other polygon shapes may be used, such as the five-sided embodiment 28 shown in FIG. 6. Hand wands with three or four sided core portions are considered preferred, however, as they fulfill the objects of the present invention while providing desirable manufacturing characteristics. Regardless of the number of sides chosen for a particular embodiment, the sides of a core portion meet to define interior corners of the housing cavity. The base of these corners each define a vertex at the union of the core portion and the handle portion, wherein a number of interior corner pads extend partially into the core portion cavity as will be described more fully herein below. For example, the embodiment shown in connection FIGS. 1-3 will carry a set of four interior corner pads, whereas those depicted in connection with FIGS. 4-5 will have a set of three interior corner pads.

The invented hand wand embodiments described herein are configured with a plurality of high intensity LEDs in order to provide an ample visual signal that is readily perceptible by visual signaling targets. It is preferred At least one side of the core portion is equipped with a plurality of LEDs, and a user of the device holds the wand so that the side with the plurality of LEDs faces in the general direction of the visual signaling target. In the exemplary embodiment of the hand wand depicted in FIGS. 1-3, three sides 8, 10 and 12 of the wand are each provided with a plurality of LEDs 29 in order to enhance the visual perception of the device by the visual signaling targets. It should be appreciated that various embodiments should include at least one, and preferably multiple sides carrying a plurality of LEDs.

Preferably, the present invention is configured with at least one side that does not have a plurality of LEDs, such as the back side 14 in the embodiment shown in FIG. 1-3 or 26 in FIG. 5. The one or more sides generally facing the user of the device when the hand wand is in use may be configured without LEDs so as not to impair the vision of the user unnecessarily, and to provide a surface for the attachment of optional elements. For example, the embodiment shown in connection with FIG. 4 is configured with LEDs only on the front side 24, while the left side 20 and right side 22 do not carry LEDs. For enhanced visual perception of the device by signaling targets, however, three sided configurations preferably have two active LED sides and one blank side (see FIG. 5).

LED arrays may also optionally be provided on the top ends of the device, such as the plurality of top LEDs 30 shown in connection with hand wand 2. The top LEDs 30 may be used, for instance, to enhance the visibility of the device to visual signaling targets, or may inclusively or exclusively be used to provide other functions or modes use of the device. For example, top LEDs may be used to provide a flashlight function to a user of the hand wand 2, or may be used to both enhance visibility of the device and be used to direct others to specific locations. Other such combinations will be readily appreciated by those skilled in the art.

Further elements may be provided in exemplary embodiments to increase the usefulness of the device, such as optional belt clip 32 (see FIGS. 1, 3 and 5). Users of visual signaling devices may use such devices intermittently. In those cases, it is desirable to be able to free up both of the user's hands while keeping the device available for quick activation if needed. The belt clip 32 may be configured as a clip biased toward an external surface of the wand housing (e.g., the wand housing 6 in FIGS. 1 and 3) when a person's belt or other clothing or accoutrement (not shown) is inserted therebetween. The belt clip 32 is preferable positioned with its fixed end being closest in proximity to the bottom end of the hand wand 2 so that the handle portion 4 is readily available for gripping when the wand 2 is accessed from a belt. Other positions should be readily apparent to those skilled in the art in applications that demand ease of access when clipped to locations other than the belt. Note that the optional inclusion of the belt clip 32 may be provided by fasteners (e.g., rivets 33 shown in FIG. 3) driven through precut or preformed through-holes (e.g., holes 34 in FIGS. 7-8) on a side of the core portion 6.

Figure 7:
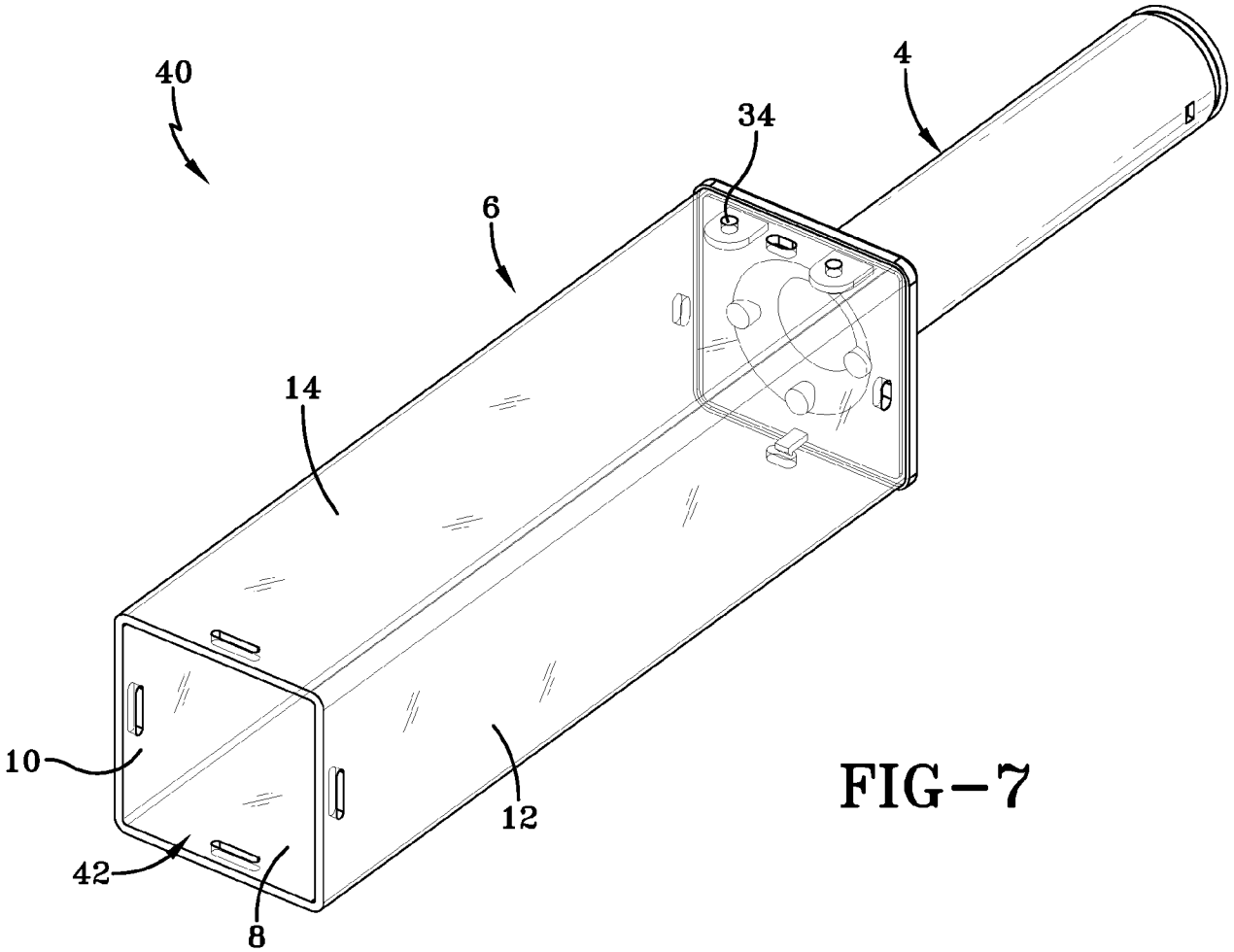
FIG. 7 is an elevated back right perspective view of a wand housing.
Figure 8:
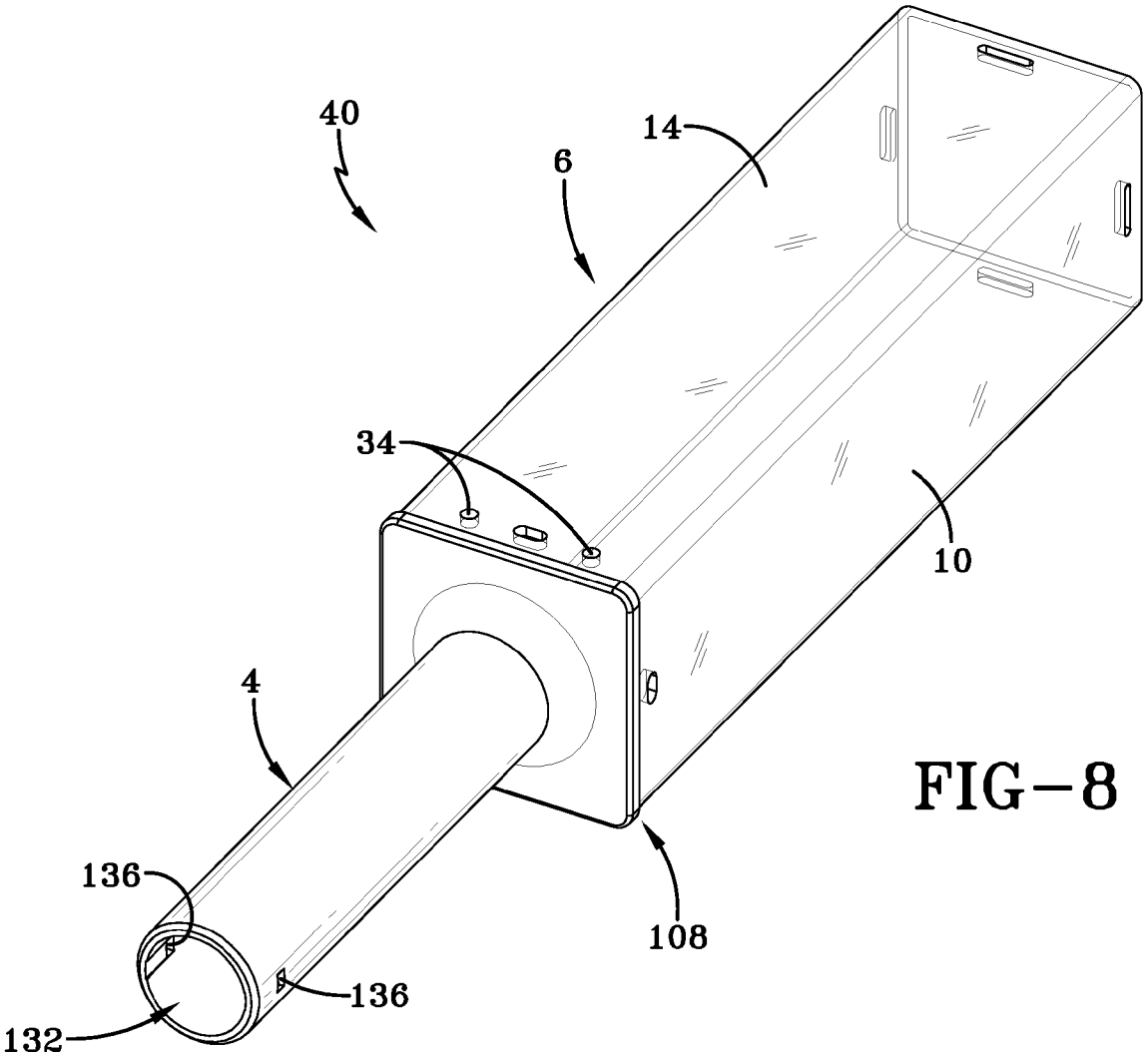
FIG. 8 is a lower back left perspective view of the wand housing shown in FIG. 7.

Turning to FIGS. 7-8, the wand housing 40 of the embodiment shown in connection with FIGS. 1-3 is depicted in top and bottom perspective views, respectively. The sides (8, 10, 12 and 14) of the core portion 6 of the housing 40 are made of transparent or translucent material (i.e., light permeable) such as polycarbonate plastic, or a combination thereof. For instance, it is preferred for manufacturing cost considerations to utilize polycarbonate translucent plastic material with highly polished transparent portions of the core portion in areas where LEDs will be positioned upon final assembly to allow for high light transmission through the material. Preferably, the wand housing 40 is molded as a single component and formed of polycarbonate plastic material, wherein the handle portion 4 is coated with an opaque substance to hide the internal elements of the hand wand. Reflective surfaces are provided to partially cover the core portion as further provided below.

To further enhance the visibility of the hand wand preferred embodiments employ highly reflective surfaces on the exterior of the core portion. For instance, FIGS. 1-3 are depicted with preferred 3M Diamond Grade yellow retro-reflective tape adhered to the side external surfaces. Singular reflective tape portions pre-cut to fit the external sides are preferred to speed assembly of the device, but multiple smaller reflective tape portions may be used. Additionally, holes may be pre-cut in the reflective tape at locations positioned over internal mounting positions of the LEDs employed in a given application. FIGS. 1-3 shown an example wherein two vertical rows of holes are cut on the front side tape for 12 front side LEDs, and one vertical row of holes are cut on the left and right side tapes for 6 side LEDs on each of the left and right sides. It should be appreciated that other configurations may be employed in a given application without departing from the teachings of the present disclosure, in order to provide highly visible high intensity light from LEDs housed with the core portion of the wand housing.

It is preferred that the reflective tape be adhered to the external surfaces, but other methods of providing reflective surfaces may be employed, including but not limited to those in which the reflective surface is adhered to the interior surface of the housing, the reflective surface is an inherent material property of the wand housing material, or those in which a reflective surface is mechanically mounted on the housing sides by, for instance, screws, rivets or other such known methods of attachment. The use of other comparable methods to provide reflective surfaces should be sufficient to provide backup visual signals for warning visual signal targets in the event that the power source of the device fails, and should enhance the overall perceptibility of the device when in use.

Figure 9:
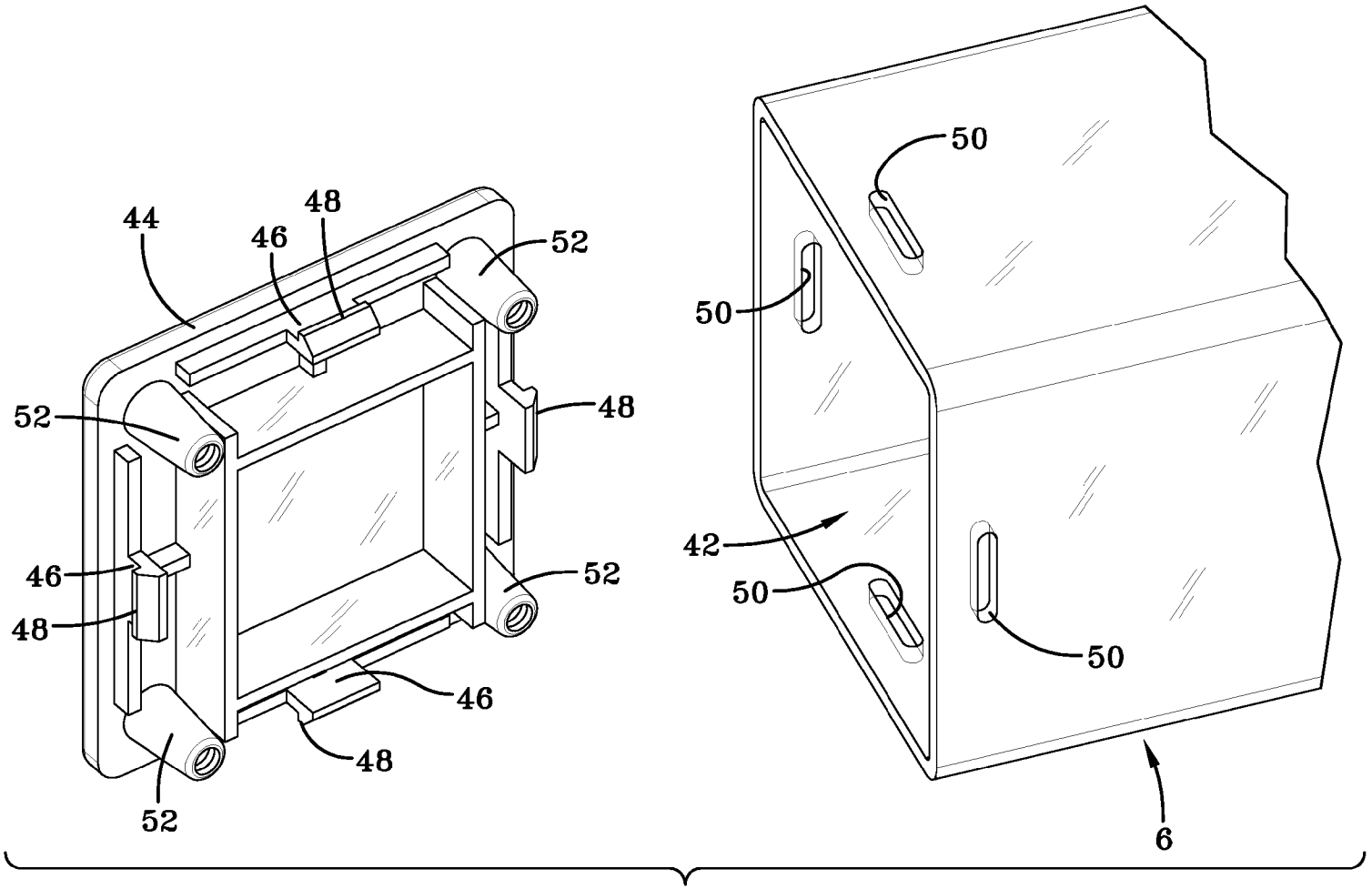
FIG. 9 is a detailed view of the top opening of the of the wand housing shown in FIG. 7.

Returning to FIG. 7, the wand housing 40 is shown with a preferable top opening 42 of the core portion 6. Preferred embodiments are provided with a top opening 42 to allow access to the housing cavity defined by the wand housing to ease installation of the internal components of the invention. The core portion 6 may be closed with no such top opening, but it is considered preferred to provide access to improve the assembly process in time and cost. A close up view of the top opening 42 of the core portion 6 is depicted in FIG. 9, wherein a cap 44 is shown disconnected from the core portion 6. In embodiments that include a plurality of top LEDs (e.g., 30 in FIG. 1), the cap 44 is preferably partially transparent to permit light emitted from the top LEDs to be transmitted with minimal interference. The cap 44 generally seals the housing cavity and the internal components, and protects the wand electronics from moisture, dirt and other undesirable disturbances.

The cap 44 should be removably attachable to the wand core 6 at a top opening 42 such that the internal components of the hand wand may be installed during the assembly process, followed by attachment of the cap 44. It is desirable, but not necessary, for the cap 44 to be removably attached for later access to any internal components that are damaged or failed for replacement purposes. In order to provide optimal levels of protection during normal use, however, the cap 44 should be secured in a manner that provides sufficient retention forces over the expected life of the hand wand. Preferred embodiments utilize locking tabs 46 extending downwardly from the cap 44 and into the housing cavity when the cap 44 is seated on the core portion 6 so as to cover the top opening 42. The locking tabs 46 may be configured with outwardly projecting flanges 48 to provide a means of retention when the cap 44 is seated. The locking tabs 46 deform slightly inwardly when the cap 44 is pressed onto the top opening 42, biasing the locking tabs 46 outwardly until each of the outwardly projecting flanges 48 locks into cap flange receptacles 50 present in each side of the core portion 6. The receptacles 50 may be, for example, preformed or precut through-holes or notches on the interior surfaces. Other comparable methods of attachment may be used without departing from the teachings of the present invention, such as hinge and latch assemblies, use of adhesives, spring latch assemblies and other such means of attachment.

Figure 10:
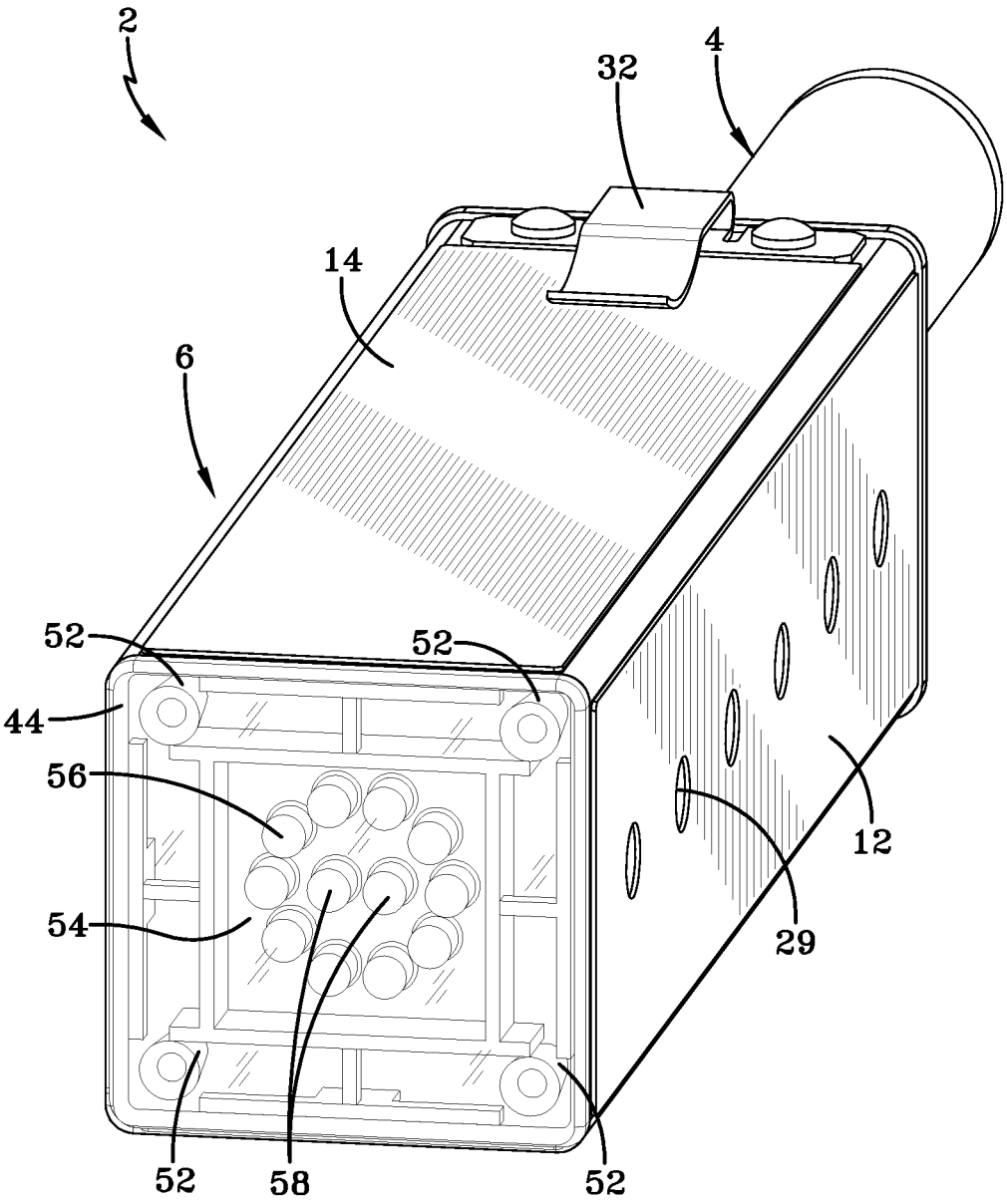
FIG. 10 is top view of the embodiment shown in FIG. 1.

Additional features of an exemplary cap 44 include a plurality of screw bosses 52 extending downwardly into the housing cavity for receiving screws or other fasteners used for retaining a top printed circuit board (PCB) against the cap 44. The top PCB (not shown) carries a plurality of top LEDs (e.g., 30 in FIG. 1) if desired. The top PCB may also be used to interconnect additional wand core components as will be described in detail more fully below. FIG. 10 shows a more detailed perspective view of the top of the embodiment of the hand wand 2 depicted in FIGS. 1-3. The plurality of top LEDs 30 mounted on the top PCB 54 are visible through a transparent portion of the cap 44. The bottoms of the screw bosses 52 in which mounting screws secure the top PCB 54 to the cap 44 are visible as well.

When it is desirable to provide the surfaces of opaque reflective material as reflective tape adhered to the external surfaces of the core portion 6 sides, the reflective material may be precut—as in FIGS. 1-3 to for the plurality of LEDs 29—to allow for the transmission of light from the plurality of LEDs positioned on a given side through the reflective material. In a similar manner, the reflective material may include a through-hole to provide access to the cap 44 locking tabs 46 to users so that the cap 44 may be removed. Alternatively, as shown in the exemplary embodiment shown in FIG. 10, the reflective material may cover any cap flange receptacles (see 50 in FIG. 9). Similar modifications may be made as will be appreciated by those skilled in the art if the means of providing reflective surfaces is one other than external adhered reflective tape.

An additional feature of the present invention is the multi-function aspect of the device. While primarily conceived to provide an improved visual signaling device to the public, another object of the invention is for the device to provide the user with multiple functions. For instance, the exemplary embodiment shown in FIG. 10 includes a plurality of top LEDs 30. In this embodiment, the plurality of top LEDs 30 includes a set of white LEDs 56 arranged in an annular ring, and a pair of red LEDs 58 positioned adjacent to one another inside of the set of white LEDs 56. The set of white LEDs 56 are included in the plurality of top LEDs 30 to provide flashlight or pointing functionality to the hand wand 2. In one mode of operation, the internal circuitry of the hand wand 2 is preprogrammed to illuminate the set of white LEDs 56 so that the device may be pointed at a parking spot, for instance, to visually signal a driver of the specific parking location for the vehicle. They may also be used to provide light while engaging in other activities, such as changing a tire, inspecting the contents of documents or vehicle interiors, or any other activity in which flashlight functionality is desirable. In another mode of operation, the hand wand 2 is preprogrammed to illuminate the set of red LEDs 58 in a pulse pattern. Such a mode is useful as an attention getting device, for instance, enabling the user of the wand 2 to point it at a subject for clearer reference regarding the identity of the target of the visual signal in crowds.

It will be appreciated by those skilled in the art that the sets of white 56 and red 58 LEDs may exist as separate discrete subsets of LEDs in the plurality of top LEDs 30. This disclosure references "sets" of LEDs as any subset of LEDs, including all LEDs present in a plurality. For example, a plurality of LEDs may include multi-colored LEDs capable of displaying two or more colors. Preprogrammed illumination schemes may then be utilized to choose the color of light emitted by the LEDs as a group, or individually in a plethora of combinations to suit the particular needs of a user in a given application. Thus, any reference herein to specific single- or multi-color LEDs in specific combinations should be considered exemplary, illustrative or preferred, but not as limiting the claimed invention.

Figure 11:
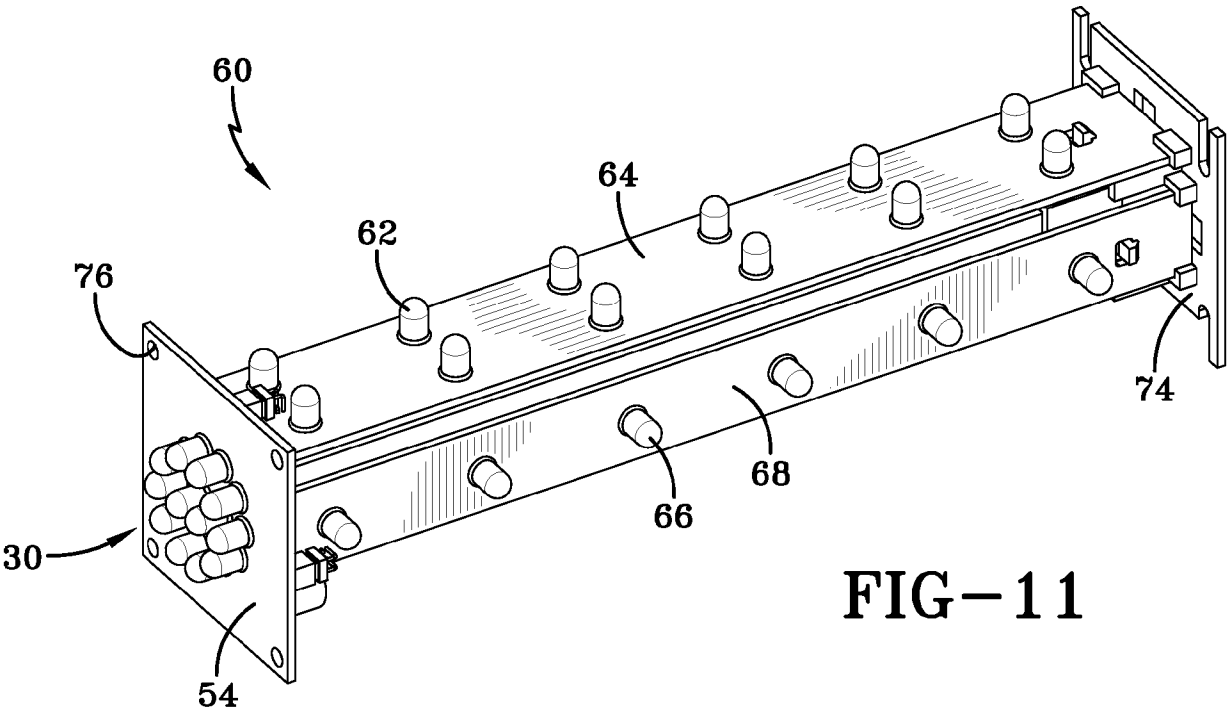
FIG. 11 is a perspective view of an exemplary embodiment of a wand core element of the invention.

Turning now to FIG. 11, an exemplary wand core 60 is shown in perspective view configured for the embodiment of the wand (2) shown in FIG. 1. For the purposes of this disclosure, a "wand core" is considered to encompass the elements of a hand wand that emit light (i.e., the plurality of LEDs), elements that support the LEDs, elements that support the LEDs or provide support to LED supporting elements, elements that position the LEDs or other wand core elements within the wand housing, and elements that secure or mount wand core elements to the wand housing.

Some elements of the wand core 60 as illustrated in FIG. 11 may include: a plurality of top LEDs 30 mounted upon a top PCB 54, a plurality of front LEDs 62 mounted upon a front PCB 64, a plurality of left LEDs 66 mounted upon a left PCB 68, a plurality of right LEDs 70 mounted upon a right PCB 72 (see FIG. 14), and a wand core base 74. More or less elements may be included depending upon the optional components and configurations chosen in a given application according to the disclosure herein. Also not shown in FIG. 11, for instance, is cap 44, depicted and described in further detail in connection with FIG. 9. The cap 44 provides a means to secure the wand core 60 to the wand housing, and may attach to the top PCB 54 via screws threaded through through-holes in the PCB 54, as at 76, for instance.

Figure 12:
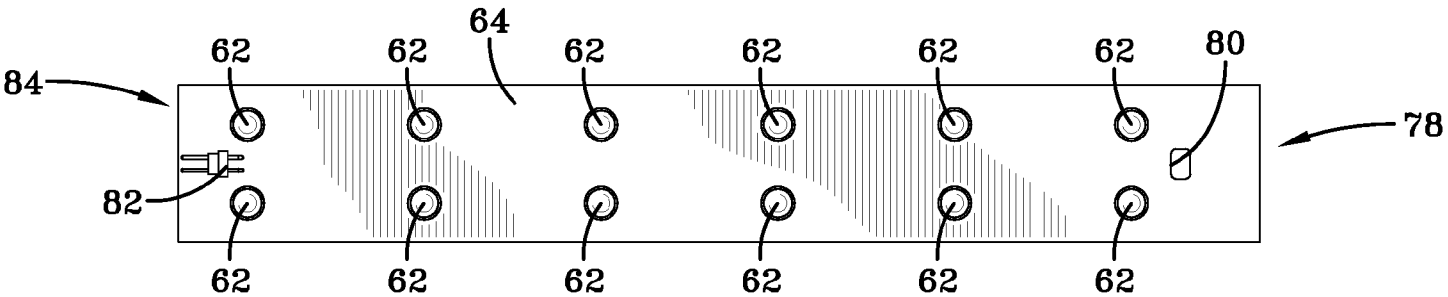
FIG. 12 is a front view of a front PCB element of the wand core shown in FIG. 11.

The side PCBs—e.g., front 64, left 68 and right 72 in the rectangular embodiment having three lighted sides—are mounted in generally vertical orientation within the core portion of the wand housing. Preferably, the plurality of LEDs mounted upon each PCB are configured in one or more vertical rows. However, it will be appreciated by those skilled in the art that other configurations are possible and included within the scope of the invention. An exemplary side PCB 64 is shown in FIG. 12. The front PCB 64 carries a plurality of front LEDs 62 configured as two rows of vertical LEDs facing the front side of the core portion. Two rows are used to direct the most light toward a visual signaling target relative to other side LEDs. The front PCB 64 is generally rectangular shaped and additionally is provided with a bottom edge 78, a retention notch 80, and an electrical connector 82 mounted thereon at a top edge 84 of the PCB 64. The individual side PCBs employed in a particular application of the present invention in accordance with the disclosure herein should be shaped with proportions similar to those of the particular side that it faces. By way of example, front PCB 64 is rectangular shaped with its top 84 and bottom 78 edges being shorter than its vertical sides.

Figure 14:
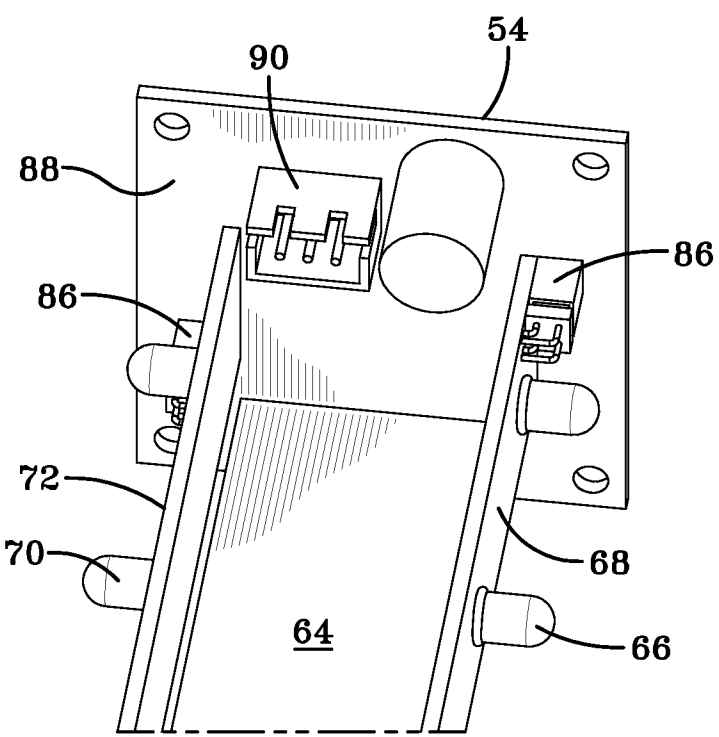
FIG. 14 is a detailed bottom back view of the top end of the wand core shown in FIG. 11.
Figure 13:
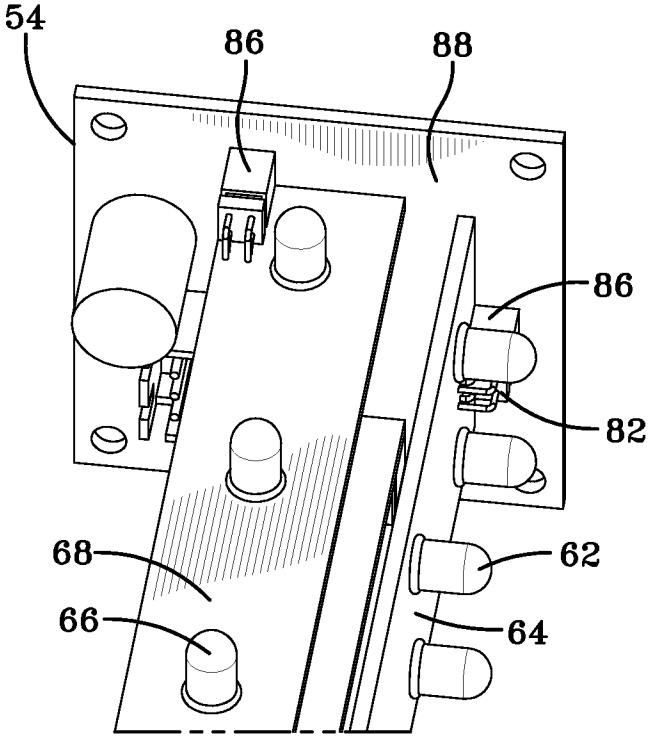
FIG. 13 is a detailed bottom left view of the top end of the wand core shown in FIG. 11.
Figure 15:
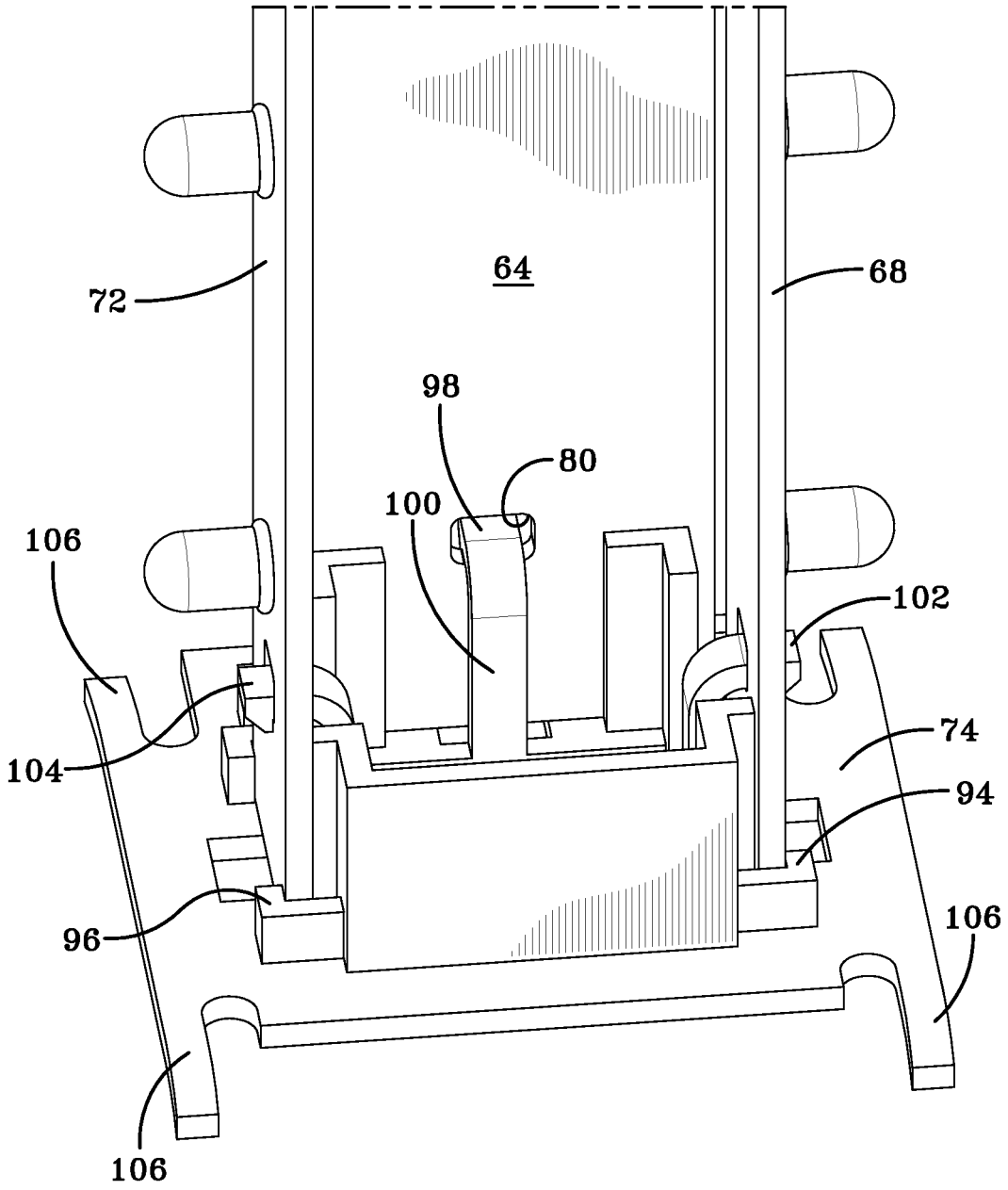
FIG. 15 is a detailed back view of the bottom end of the wand core shown in FIG. 11.
Figure 16:
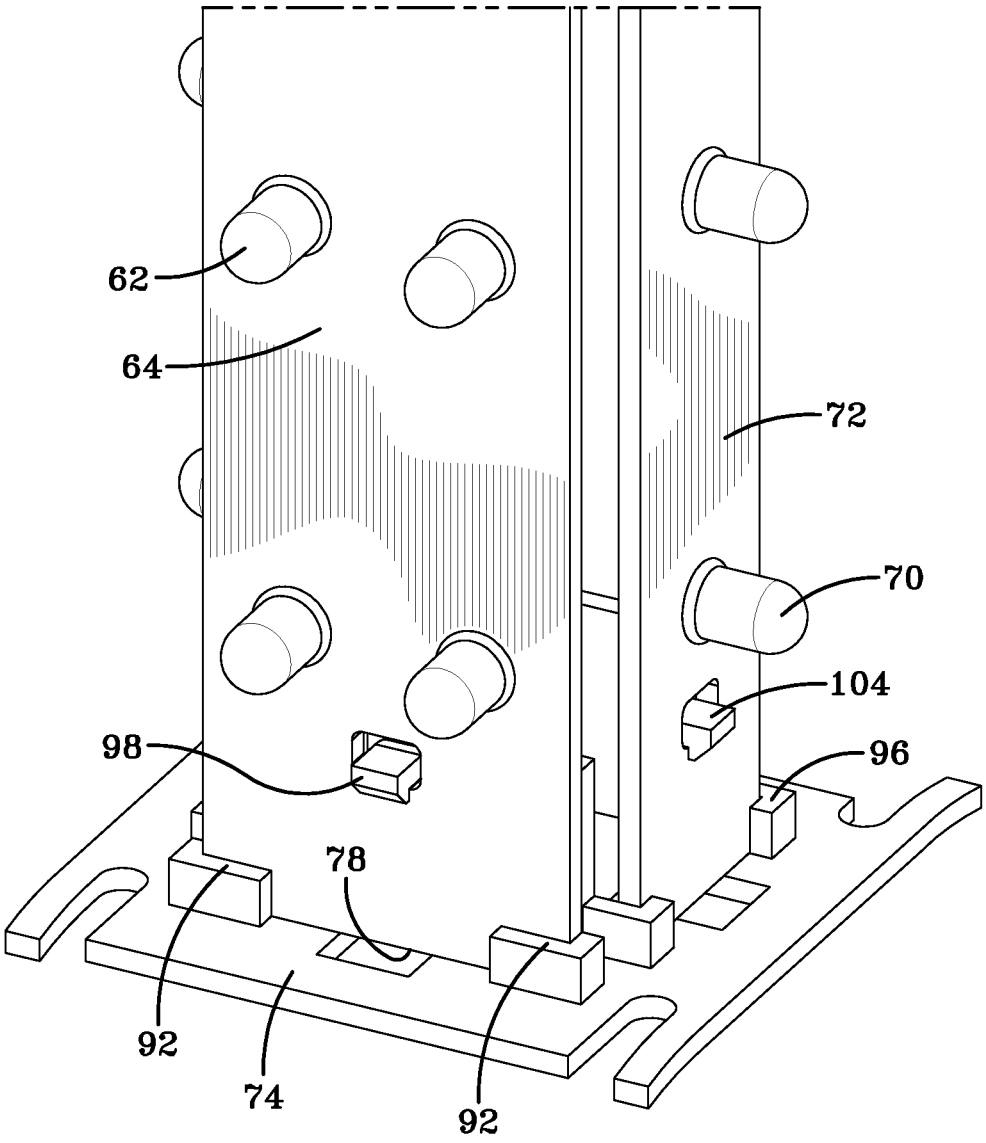
FIG. 16 is a detailed front view of the bottom end of the wand core shown in FIG. 11.
Figure 18:
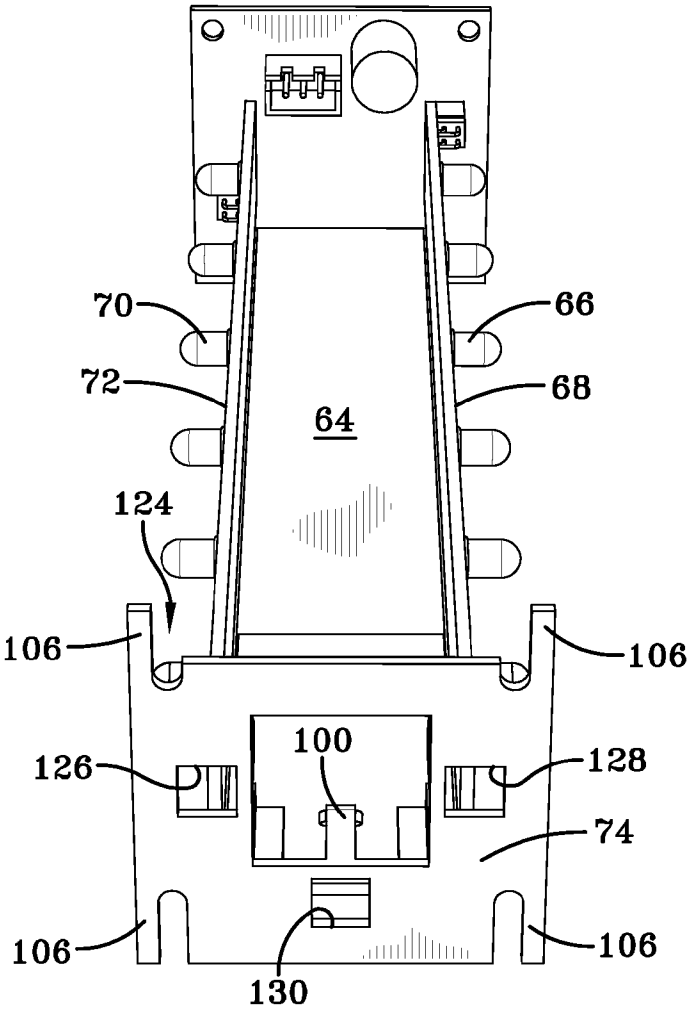
FIG. 18 is a detailed bottom view of the bottom end of the wand core shown in FIG. 11.

Turning to FIGS. 13-18, the assembly details of the wand core 60 are shown in greater detail. FIG. 13 is a perspective view from the bottom of the top PBC 54. The top PCB 54 has an electrical connector 86 mounted on the bottom surface 88 of the PCB 54 for electrically coupling the side PCBs 64, 68 and 72 with the top PCB 54 thereby creating an electrical circuit through which the operation of the LEDs may be controlled. FIG. 14 depicts a switch connector receptacle 90 wherein a switch connector extending from an electrical connection with the switch (see FIG. 19) is coupled to the wand core 60. The switch connect receptacle 90 location on the wand core 60 is shown for illustrative purposes only and should not be considered to limit the disclosed invention. It will be appreciate that the receptacle 90 may be located at any desirable location on the wand core 60 that will provide an electrical coupling to a switch assembly as further provided below.

FIGS. 15-18 show detailed views of the bottom end of the exemplary wand core embodiment 60 wherein the side PCBs (e.g., 64, 68 and 72) are affixed to a wand core base 74. Together with the top PCB 54, the base 74 secures the side PCBs in a desired configuration such that the plurality of LEDs on a given side PCB are oriented and positioned to face outwardly from the housing cavity at toward a corresponding side of the core portion of the wand housing. The wand core 60 elements shown assembled in FIG. 11 illustrate an exemplary embodiment in which three adjacent side PCBs 64, 68 and 72 are oriented to face outwardly toward three adjacent sides of a wand housing core portion 6 such as that shown in FIGS. 1-3. It will be readily apparent that other configurations may be used as described in connection with FIGS. 5-7 with simple modifications to the exemplary embodiment described herein.

The wand core base 74 is coupled to and retains each of the side PCBs 64, 68 and 72 in a given application in the desired orientation. It is preferred that the wand core base 74 constrains side PCB movement in all three orthogonal directions (i.e., vertically and in both orthogonal directions of the horizontal plane) for durability, electrical component protection and product integrity purposes. In the preferred exemplary embodiment, the base 74 is coupled to each side PCB 64, 68 and 72, thereby restricting movement in the horizontal plane with an alignment wall projecting upwardly from the base 74 sized to receive a bottom edge of the corresponding side PCB. For example, the bottom edge 78 of the front PCB 64 is received into the front alignment wall 92 projecting upwardly from the base 74. Similar left 94 and right 96 alignment walls are provided from the left 68 and right 72 PCBs, respectively. While other mechanical or form methods of restraining horizontal movement will be readily apparent to those skilled in the art, the illustrative example disclosed is preferred due to its simplicity, cost and the ability to include the described features in a single molded unit in the manufacture of the base 74.

Similarly, it is preferred that vertical movement of any side PCBs included in an embodiment be constrained relative to the base. The present preferred method utilizes upwardly projecting outwardly biased PCB retention arms with outwardly projecting locking flanges disposed on the upper edge of the arms. The outwardly projecting flanges lock vertical movement of a side PCB relative to the base when the PCB is snapped onto the arm by inserting the locking flange into the corresponding side PCB's retention notch. By way of illustrative example, the preferred means of constraining both horizontal and vertical movement of the front PCB 54 relative to the base 74 employs a front alignment wall 92 receiving the front PCB bottom edge 78 and a locking flange 98 of a front retention arm 100 snapped into the front PCB retention notch 80. The left 68 and right 72 PCBs likewise pair with left 94 and right 96 alignment walls, respectively, and the left 102 and right retention arms 104, respectively.

Figure 17:
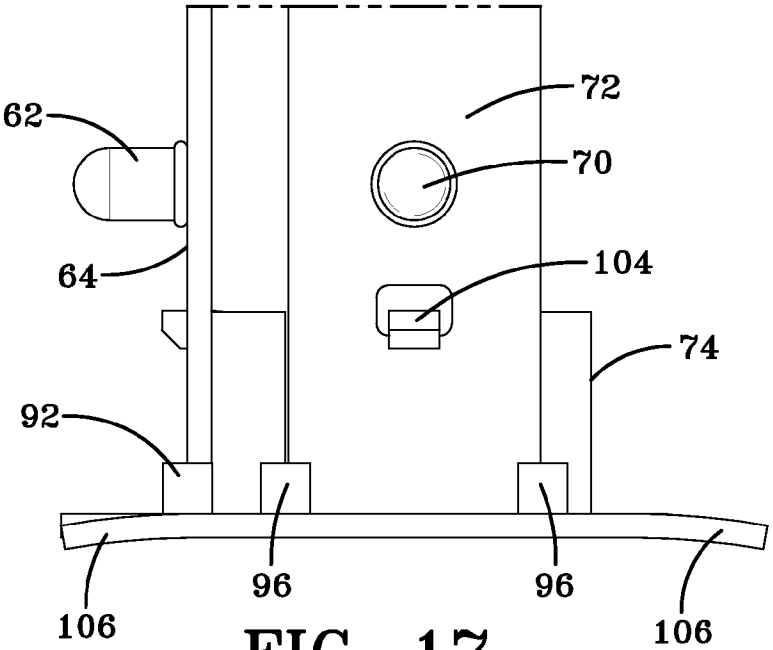
FIG. 17 is a detailed right side view of the bottom end of the wand core shown in FIG. 11.

The base 74 may be further provided with a plurality of downwardly curved legs 106 extending laterally therefrom. FIG. 17 illustrates the downward curve of the legs 106 wherein the legs 106 together function generally as leaf springs. Each of the curved legs 106 rests upon an interior corner pad extending into the core portion cavity from the vertices at the base of the core portion sides as described above (e.g., see 108 in FIG. 8). The configuration of the legs described permits for a generally upward bias of the wand core (i.e., toward the cap), which is mounted within the housing cavity in the core portion, extending along its entire vertical length. The upward bias provides a compressive force sufficient to maintain the position of the plurality of LEDs once the hand wand is assembled, which is important in embodiments utilizing reflective tape exterior surfaces with holes cut to transmit the LED generated light through the housing sides. Furthermore, the upward bias afforded by a base will allow for the correction of reasonable manufacturing tolerances resulting in variations of the total wand core length, the core portion housing cavity length, or both. This aspect of the invention may also be used to eliminate looseness in the wand core assembly and prevent rattling of the internal components.

Note that the interior corner pads extending into the core portion cavity from the vertices as described above may be positioned vertically above the vertices if desired, but it is preferred that they be positioned at or near the vertices to make full use of the length of the core portion for lighting purposes. Embodiments making full use of the core portion will exhibit greater illumination intensity and therefore be relatively more perceptible to visual signaling targets.

Figure 19:
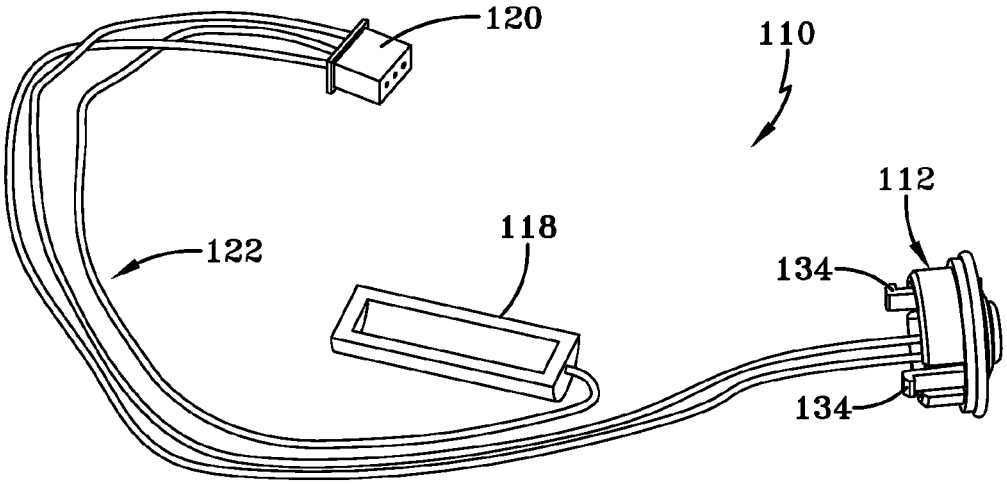
FIG. 19 is a perspective view of an exemplary switch assembly embodiment.
Figure 20:
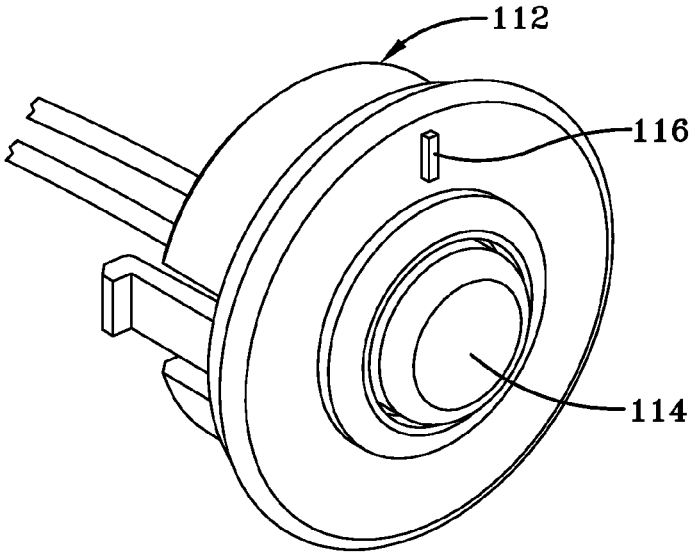
FIG. 20 is a perspective view of the switch of the switch assembly shown in FIG. 19.

Turning now to FIGS. 19-20, an exemplary switch assembly 110 is depicted as a means for providing electrical power to the one or more plurality of LEDs, and providing switching amongst multiple preprogrammed illumination schemes. A switch assembly according to the present disclosure includes generally a switch 112 actuatable between at least two preprogrammed illumination schemes. For example, the switch in FIGS. 19-20 is a three position rocker switch 114, and is optionally provided with a switch position indicator 116 to provide a visual or tactile indication of the switch position. Many other switch configurations may be employed to implement the switch 112 in accordance with the teachings of the present disclosure, as will be appreciated by those skilled in the art.

The switch assembly 110 is further provided with a power source 118 electrically coupled to the switch 112 to provide power to the LEDs. The power source may be stored in the handle portion of the housing cavity, being removable as a means of replacing the power source when it is diminished or no longer functions. The switch 112 transmits power to the wand core via a switch connector 120 extending from an electrical connection 122 with the switch 112. The connector 120 is then coupled to the receptacle (e.g., receptacle 90 in FIG. 14), electrically connecting the switch assembly 110 to the wand core. In the exemplary embodiment of the wand core 60 shown in connection with FIGS. 11-18, the base 74 configuration provides sufficient clearance with respect to one or more core portion sides to permit the electrical connection 122 to extend from the bottom of the handle portion 4 to the receptacle 90 mounted to the top PCB 54.

Additionally, the legs of the base may be defined generally by corner sections of a flat plate generally shaped to fill the cross sectional area of the core portion housing cavity. In the event that the base is configured in such a manner leaving no clearance around the perimeter of the base (such as void 124 shown in FIG. 18, for example), at least one electrical opening in the base should be provided (e.g., voids 126, 128 or 130 in FIG. 18) to permit an electrical connection to extend from the switch assembly through the base to the switch connector receptacle, or the switch connector receptacle must extend below the base to permit electrical coupling of a switch assembly to the wand core.

It is also preferred that the switch is mounted within the handle portion of the wand housing generally for ease of access for hand wand users. It is further preferred that the wand housing 40 (FIG. 8) be formed with a bottom opening 132 (FIG. 8) of the handle portion 4 wherein the switch 112 (FIG. 2) may be mounted, thereby closing the bottom opening 132 of the handle portion 4. Balancing manufacturing cost and ergonomic purposes, a round-shaped handle portion 4 is preferred that flares outwardly to join the handle portion 4 with the core portion 6. The switch 112 may be provided with one or more outwardly biased locking arms 134 (FIG. 19) extending upwardly from the switch, which fit into one or more corresponding receiving handle notches 136 (FIG. 8) located in the handle portion. Those skilled in the art will appreciate that, while the exemplary embodiment of the switch assembly herein described is preferred, other configurations are readily adaptable according to the teachings described in this disclosure.

The general structure and interconnection of the hand wand and its elements described above permit users of the invention to readily design hand wands with switchable preprogrammed illumination schemes or functions. For example, the preferred embodiment employs two active switch positions in a rocker configuration wherein a first switch position activates a subset of LEDs that emit white light and are mounted on the top PCB to provide the functionality of a flashlight or visual pointer device. A second active switch position corresponds to a preprogrammed illumination scheme that actuates a repeated pattern of LED illumination. The illuminated LEDs in the second switch position are preferably a subset of red LEDs mounted upon three side PCBs mounted within a rectangular shaped core portion. Of course, those skilled in the art will appreciate that multicolor LEDs may be used in more than one mode where multiple colors are desired in a location. For example, red/white LEDs may be mounted upon the top PCB to be activated in both the first and second active switch positions, but in either red or white light emission modes. Other combinations of monochrome and multicolor LEDs, positions, and lighting patterns may be applied without departing from the teachings of the disclosure.

To achieve high levels of light emission intensities, it is currently considered the best mode of the preferred embodiment of the invention to utilize a combination of OPTEK, Inc. manufactured TT electronics White High-Intensity LED Lamps (#OVLEW1CB9) and Cree, Inc. manufactured 5-mm Red and Amber Round LEDs (#C503B). The OPTEK LEDs are employed as a white light source on the top PCB for use as a flashlight, and the Cree LEDs are employed as a red light source on the PCBs for all lighted sides. Both LEDs emit high-intensity light with 20 mA current suitable for use with two standard AA batteries as the power source.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A hand wand comprising:

a wand housing defining a housing cavity comprising:

a handle portion at a bottom end of the wand housing;

a bottom opening of the handle portion; and a rectangular core portion at a top end of the wand housing and having a front side, a left side, a right side, and a back side, wherein each of the front side, left side, right side and back side further comprise a surface of opaque reflective material, wherein the surface of opaque reflective material of each of the front side, left side, right side and back side surfaces is adhesively coupled externally thereto;

a wand core mounted within the housing cavity of the rectangular core portion of the wand housing comprising:

a plurality of front LEDs mounted upon a vertical front PCB facing the front side of the rectangular core portion; and a wand core base retained within the housing cavity of the rectangular core portion of the wand housing and coupled to the front PCB, thereby restraining movement in the horizontal plane;

a circular opening in the surface of the opaque reflective material located adjacent to each LED in the plurality of front LEDs; and a switch assembly comprising:

a power source housed within the handle portion and accessible via the bottom opening of the handle portion; and a switch electrically coupling the front PCB to the power source, wherein the switch is mounted on the handle portion.

2. The hand wand of claim 1, wherein the wand housing is molded from light permeable material to define the housing cavity.

3. The hand wand of claim 2, the wand core further comprising:

a plurality of top LEDs mounted upon a horizontal top PCB; and a cap coupled to the top PCB, the cap further connected to and closing a top opening of the core portion.

4. The hand wand of claim 3, the wand core base further comprising:

a set of four downwardly curved legs extending to be seated upon a set of four interior corner pads extending into the core portion cavity; and a front alignment wall projecting upwardly from the wand core base to receive a bottom edge of the front PCB.

5. The hand wand of claim 3, wherein the switch assembly further comprises a switch connector extending from an electrical connection with the switch and connected to a PCB switch connector receptacle; and wherein the switch is actuatable between at least two preprogrammed illumination schemes.

6. The hand wand of claim 5, wherein the at least two preprogrammed illumination schemes include the selection of:

a subset of actively powered LEDs; and a repeatable pattern of LED illumination.

7. The hand wand of claim 6, further comprising a belt clip mounted on the back side external surface.

8. The hand wand of claim 7, the wand core further comprising:

a plurality of left LEDs mounted upon a vertical left PCB facing the left side of the rectangular core portion; and a plurality of right LEDs mounted upon a vertical right PCB facing the right side of the rectangular core portion, wherein the wand core base is coupled to the front PCB, the left PCB and the right PCB, thereby restraining movement in the horizontal plane, and wherein the top PCB is further electrically coupled to the front PCB, the left PCB and the right PCB.

9. A hand wand comprising:

a wand housing defining a housing cavity comprising:

a handle portion at a bottom end of the wand housing;

a bottom opening of the handle portion;

a core portion at a top end of the wand housing and having a front side, a left side and a right side; and a top opening of the core portion, wherein the wand housing is molded of a light permeable material and the handle portion is coated with an opaque material, thereby hiding internal components of the hand wand;

a wand core comprising:

a cap removably connected to and closing the core portion at the top opening;

a plurality of top LEDs mounted upon a horizontal top PCB coupled to the cap;

a plurality of front LEDs mounted in a vertical row upon a front PCB, wherein the front PCB is electrically coupled to the top PCB and faces the front side of the core portion; and a switch assembly comprising:

a switch mounted within the handle portion;

a switch connector extending from an electrical connection with the switch and connected to a PCB switch connector receptacle; and a power source electrically coupled to the switch, wherein the power source is removable through the bottom opening of, and housed within, the handle portion.

10. The hand wand of claim 9, the wand housing further comprising:

three interior vertices defined between the front side, left side and right side of the core portion; and the wand core further comprising:

a plurality of left LEDs mounted in a vertical row upon a left PCB, wherein the left PCB is electrically coupled to the top PCB and faces the left side of the core portion; and a plurality of right LEDs mounted in a vertical row upon a right PCB, wherein the right PCB is electrically coupled to the top PCB and faces the right side of the core portion, wherein the wand core base is connected to the left PCB and the right PCB and comprises a set of three downwardly curved legs extending to be seated upon a set of three interior corner pads extending into the core portion cavity from the three interior vertices of the core portion.

11. The hand wand of claim 9, the wand housing further comprising a back side on the core portion; and the wand core comprising:

a plurality of left LEDs mounted in a vertical row upon a left PCB, wherein the left PCB is electrically coupled to the top PCB and faces the left side of the core portion; and a plurality of right LEDs mounted in a vertical row upon a right PCB, wherein the right PCB is electrically coupled to the top PCB and faces the right side of the core portion, wherein the wand core base is connected to the front PCB, the left PCB and the right PCB, thereby restraining movement of the front PCB, the left PCB and the right PCB relative to the wand core base in all three orthogonal directions.

12. The hand wand of claim 11, the wand core base further comprising a set of four downwardly curved legs extending to be seated upon a set of four interior corner pads extending into the core portion cavity.

13. The hand wand of claim 12, the wand core base further comprising:

a front alignment wall projecting upwardly from the wand core base to receive a bottom edge of the front PCB;

a front upwardly projecting retention arm having a front locking flange disposed thereon and wherein the front locking flange is snapped into a retention notch of the front PCB;

a left alignment wall projecting upwardly from the wand core base to receive a bottom edge of the left PCB;

a left upwardly projecting retention arm having a left locking flange disposed thereon and wherein the left locking flange is snapped into a retention notch of the left PCB;

a right alignment wall projecting upwardly from the wand core base to receive a bottom edge of the right PCB; and a right upwardly projecting retention arm having a right locking flange disposed thereon and wherein the right locking flange is snapped into a retention notch of the right PCB.

14. The hand wand of claim 13, further comprising:

a front opaque reflective strip coupled to an exterior surface of the front side of the core portion and having a circular opening located adjacent each LED in the plurality of front LEDs;

a left opaque reflective strip coupled to an exterior surface of the left side of the core portion and having a circular opening located adjacent each LED in the plurality of left LEDs;

a right opaque reflective strip coupled to an exterior surface of the right side of the core portion and having a circular opening located adjacent each LED in the plurality of right LEDs; and a back opaque reflective strip coupled to an exterior surface of the back side of the rectangular core portion.

15. The hand wand of claim 14, further comprising a belt clip attached outside of the wand housing to the exterior surface of the back side of the core portion.

16. A hand wand comprising:

a wand housing molded of a light permeable material and defining a housing cavity comprising:

a handle portion at a bottom end of the wand housing;

a bottom opening of the handle portion;

a rectangular core portion at a top end of the wand housing and having a front side, a left side, a right side, and a back side; and a top opening of the core portion;

a wand core comprising:

a cap removably connected to and closing the core portion at the top opening;

a plurality of top LEDs mounted upon a horizontal top PCB coupled to the cap;

a plurality of front LEDs mounted in a vertical row upon a front PCB, wherein the front PCB is electrically coupled to the top PCB and faces the front side of the core portion;

a plurality of left LEDs mounted in a vertical row upon a left PCB, wherein the left PCB is electrically coupled to the top PCB and faces the left side of the core portion;

a plurality of right LEDs mounted in a vertical row upon a right PCB, wherein the right PCB is electrically coupled to the top PCB and faces the right side of the core portion; and a wand core base connected to the front PCB, the left PCB and the right PCB, thereby restraining movement of the front PCB, the left PCB and the right PCB in the horizontal direction;

a switch assembly comprising:

a switch mounted on and closing the handle portion at the bottom opening and wherein the switch is actuatable between at least two preprogrammed illumination schemes;

a switch connector extending from an electrical connection with the switch and connected to a PCB switch connector receptacle; and a power source electrically coupled to the switch;

a front reflective tape coupled to an exterior surface of the front side of the core portion and having a circular opening located adjacent each LED in the plurality of front LEDs;

a left reflective tape coupled to an exterior surface of the left side of the core portion and having a circular opening located adjacent each LED in the plurality of left LEDs;

a right reflective tape coupled to an exterior surface of the right side of the core portion and having a circular opening located adjacent each LED in the plurality of right LEDs; and a back reflective tape coupled to an exterior surface of the back side of the rectangular core portion.

17. The hand wand of claim 16, wherein the plurality of top LEDs are comprised of a set of white LEDs and a set of red LEDs, and wherein the plurality of front LEDs, the plurality of left LEDs and the plurality of right LEDs are each comprised of red LEDs.

18. The hand wand of claim 17, wherein at least two preprogrammed illumination schemes comprise:

a circuit activating only the red LEDs in a pulse pattern for use as an attention getting device; and a circuit activating only the white LEDs for use as a flashlight device.

* * * * *